US005569074A

United States Patent [19]

Gressel

[11] Patent Number: 5,569,074

[45] Date of Patent: Oct. 29, 1996

[54] VENTILATED WORKSTATION WITH TURNTABLE

[75] Inventor: Michael Gressel, Cincinnati, Ohio

[73] Assignee: The United States of America as represented by the Department of Health and Human Services, Washington, D.C.

[21] Appl. No.: 247,181

[22] Filed: May 20, 1994

[51] Int. Cl.[6] ..... B08B 15/02

[52] U.S. Cl. ..... 454/56; 108/142; 454/49

[58] Field of Search ..... 454/49, 56, 61, 454/62; 108/142

[56] References Cited

U.S. PATENT DOCUMENTS

| | | | |
|---|---|---|---|
| 1,409,257 | 3/1922 | Staley | 108/142 |
| 1,693,782 | 12/1928 | Hasselkus | 108/142 |
| 2,590,577 | 3/1952 | Ruemelin | 454/61 |
| 3,230,908 | 1/1966 | Grant | 108/142 |

OTHER PUBLICATIONS

*Industrial Ventilation: A Manual of Recommended Practice 21st Ed.*, American Conference of Governmental Industrial Hygienists (ACGIH), 1992.

*Primary Examiner*—Harold Joyce

*Attorney, Agent, or Firm*—Lowe, Price, Leblanc & Becker

[57] ABSTRACT

A workstation for cleaning or machining workpieces such as foundry castings includes a rotatable workpiece support positioned above a ventilated surface of the workstation. In operation, a workpiece is mounted to the rotatable support and rotated as necessary during a cleaning process to enable a user to conveniently access various surfaces of the workpiece. The cleaning process can include chipping, grinding, sanding and polishing steps. The rotatable workpiece support can include a mechanical clamp or a turntable which can be operatively locked in a desired position. Positioning of the workpiece relative to cleaning tools will reduce worker exposure to respirable particulates.

20 Claims, 3 Drawing Sheets

VENTILATED WORKSTATION WITH TURNTABLE

TECHNICAL FIELD

The present invention relates to a device for reducing the exposure of workstation operators to respirable particulates. More particularly, the present invention is directed to a ventilated workstation for use in cleaning foundry castings.

BACKGROUND ART

Most foundry castings use molds made from a sand and binder system. The binder allows the sand particles to adhere to one another so that the molds can be shaped. Green sand molds, which include a mixture of sand, clay, water, and coal dust, are commonly used in foundries. For complicated castings, cores can provide any necessary void spaces in the castings. Common core-making processes include shell, oil-baked, and no-bake.

After the molds are assembled, they are filled with molten metal. The methods for pouring molds vary greatly with the size and type of foundry. Following the mold-pouring process, the castings are allowed to cool. The castings are then removed from the molds in a process called "shakeout". Similar to the pouring operation, the shakeout operations vary greatly with the type of foundry. After shakeout, the casting may be placed in a blast machine to remove most of sand adhering to the new casting. However, some sand will be embedded or burned into the casting.

To remove the burn-in sand, the castings are cleaned by hand using pneumatic chipping and grinding tools. The grinding and chipping of the sand produces respirable silica particles, which may present a health hazard to workers if not adequately controlled. The workers use a variety of tools, including cup grinders, cone grinders, pneumatic chisels, and abrasive wheels. Engineering controls for this preparation is not universally used; many plants have no controls in place, while others may have ineffective controls, such as poorly designed ventilated tables. The National Institute for Occupational Health and Safety (NIOSH) in conjunction with the Mine Safety and Health Administration (MSHA) has approved the use of air purifying respirators with helmets, which have high efficiency particulate air (HEFA) filters and built-in face shields.

Silica may be present in at least three crystalline forms (alpha quartz, cristobalite, and tridymite), as well as amorphous (noncrystalline) forms. Amorphous silica is usually considered to be of low toxicity and may produce X-ray changes in the lung without disability. The crystalline forms of silica can cause severe lung damage (silicosis) when inhaled. Silicosis is a form of pulmonary fibrosis caused by the deposition of fine particles of crystalline silica in the lower portions (alveoli) of the lungs. Symptoms such as coughing, shortness of breath, chest pain, weakness, wheezing, and nonspecific chest illness, usually develop insidiously. Silicosis usually occurs after years of exposure, but may appear in a shorter time if exposures are very high.

The current U.S. Department of Labor, Occupational Safety and Health Administration (OSHA) Permissible Exposure Limits (PEL) for respirable crystalline silica is calculated from Equation 1:

$$PEL = \frac{10\ \text{mg/m}^2}{\%\ SiO_2 + 2}$$

In 1989, OSHA changed the PEL to 100 $\mu g/m^3$ under the Air Contaminants Standard. In July 1992, the 11th Circuit Court of Appeals vacated this standard. OSHA is currently enforcing the limit calculated by Equation 1; however, some states operating their own OSHA approved job safety and health programs will continue to enforce the 100 $\mu g/m^3$ standard. NIOSH has set its Recommended Exposure Limits (REL) at 50 $\mu g/m^3$. These values are 8-hr time-weighted averages.

The OSHA PELs are required to consider the feasibility of controlling exposures in various industries where the agents are used; the NIOSH PELs, by contrast, are based primarily on concerns relating to the prevention of occupational disease. The American Conference of Governmental Industrial Hygienist (ACGTH) has set the Threshold Limit Value (TLV) for crystalline quartz silica at 100 $\mu g/m^3$, 8-hr time-weighted averages. All of these exposure limits (PEL, REL, TLV) are for the respirable fraction of the silica containing dust.

One ventilated hand grinding bench currently used for cleaning foundry castings is described in a publication entitled "Industrial Ventilation: A Manual of Recommended Practice 21st Ed." (American Conference of Governmental Industrial Hygienists (ACGIH), 1992). The present inventors have discovered that while a ventilation work bench can reduce silica exposure, tool usage and work practices nevertheless can have an adverse effect on the worker's silica exposure.

The present invention provides for a device which can avoid adverse effects of tool usage and work practices which influence silica exposure.

DISCLOSURE OF THE INVENTION

It is accordingly one object of the present invention to provide a ventilated workstation.

Another object of the present invention is to provide a ventilated workstation having a workpiece positioning means.

A further object of the present invention is to provide a ventilated workstation which includes a rotatable workpiece support.

A further object of the present invention is to provide a ventilated workstation including a turntable which can be locked into a desired position.

A yet further object of the present invention is to provide a process for cleaning or machining workpieces such as foundry castings.

According to these and further objects of the present invention which will become apparent as the description thereof proceeds, the present invention provides a ventilated workstation, which includes:

- a bench having an upper surface;
- a plurality of ventilation openings in the upper surface;
- a rotatable workpiece support means attached to the bench for supporting a workpiece above the upper surface; and
- a ventilation manifold in fluid communication with the upper surface, at a lower portion thereof, for drawing an air flow though the upper surface.

The present invention further provides an improvement for existing ventilated workstations having ventilated work surfaces which involves a rotatable workpiece support means attached to the ventilated workstation for supporting a workpiece above the ventilated work surface.

The present invention further provides a process for cleaning foundry castings which involves:

positioning a foundry casting on a rotatable support means above a ventilated surface of work bench;

applying a vacuum source to the work bench to create a ventilation air flow through the ventilated surface; and rotating the foundry casting together with the rotatable support means to expose surfaces thereof to a cleaning operation.

BRIEF DESCRIPTION OF DRAWINGS

The present invention will be described with reference to the attached drawings which are given by way of non-limiting examples only, in which.

BEST MODE FOR CARRYING OUT THE INVENTION

The present invention is directed to a workstation for cleaning or hand-machining surfaces of a workpiece, such as a casting. The workstation includes a ventilated work bench having an upper surface which defines the primary work area of the work bench. The upper surface can be substantially horizontal or tilted at a desired angle to present a workpiece in a convenient position for cleaning or machining. The upper surface includes ventilation openings therein which can be in the form of slots, gratings, various arrays of apertures, screens, or the like.

The workstation includes a manifold in fluid communication with the ventilation openings of the upper surface. In operation, a vacuum source is connected to the manifold and air and particulates produced by the cleaning or machining of a workpiece are drawn away from the primary work area of the upper surface. A suitable vacuum source can include a vacuum pump, suction pump, fan or the like.

The work bench of the present invention also includes means, disposed on a table top, for rotatably supporting a workpiece, so that substantially all surfaces of the workpiece are accessible to a processing tool. The rotatable support can be a turntable rotatably attached to the work bench above the table top or upper surface thereof. In an alternative embodiment, the rotatable support means includes a mechanical clamp rotatably attached to the work bench above the table top or upper surface thereof.

The workstation of the present invention is particularly suitable for cleaning the surfaces of a workpiece, such as a metal casting. In this regard, the present inventor has determined that tool usage and work practices can have an adverse effect on the worker's silica exposure. That is, the direction in which a tool directs removed or discharged particulates from a workpiece has an effect on the worker's aerosol exposure. During repetitive processes, particularly in the case of heavy castings, workers tend to position the work tool in relationship to the workpiece rather than change the position of the workpiece. As a result, the positioning of the work tool often caused particulates to be discharged in the direction of the worker or else away from the direction in which entraining, venting gas flows. The addition of the rotatable workpiece support to the workstation helps the worker to position the casting in such a fashion as to direct the discharged particulates away from his breathing zone.

Although the workstation is particularly suited to clean and/or hand machine small and medium sized foundry castings of brass, grey iron, stainless steel, aluminum, etc., the workstation can also be used to provide a safe and convenient area to clean, sand, grind, cut, chisel, rout or otherwise process a variety of workpieces, including those made from plastic, wood, ceramic, porcelain, clay, etc.

Figure 1:
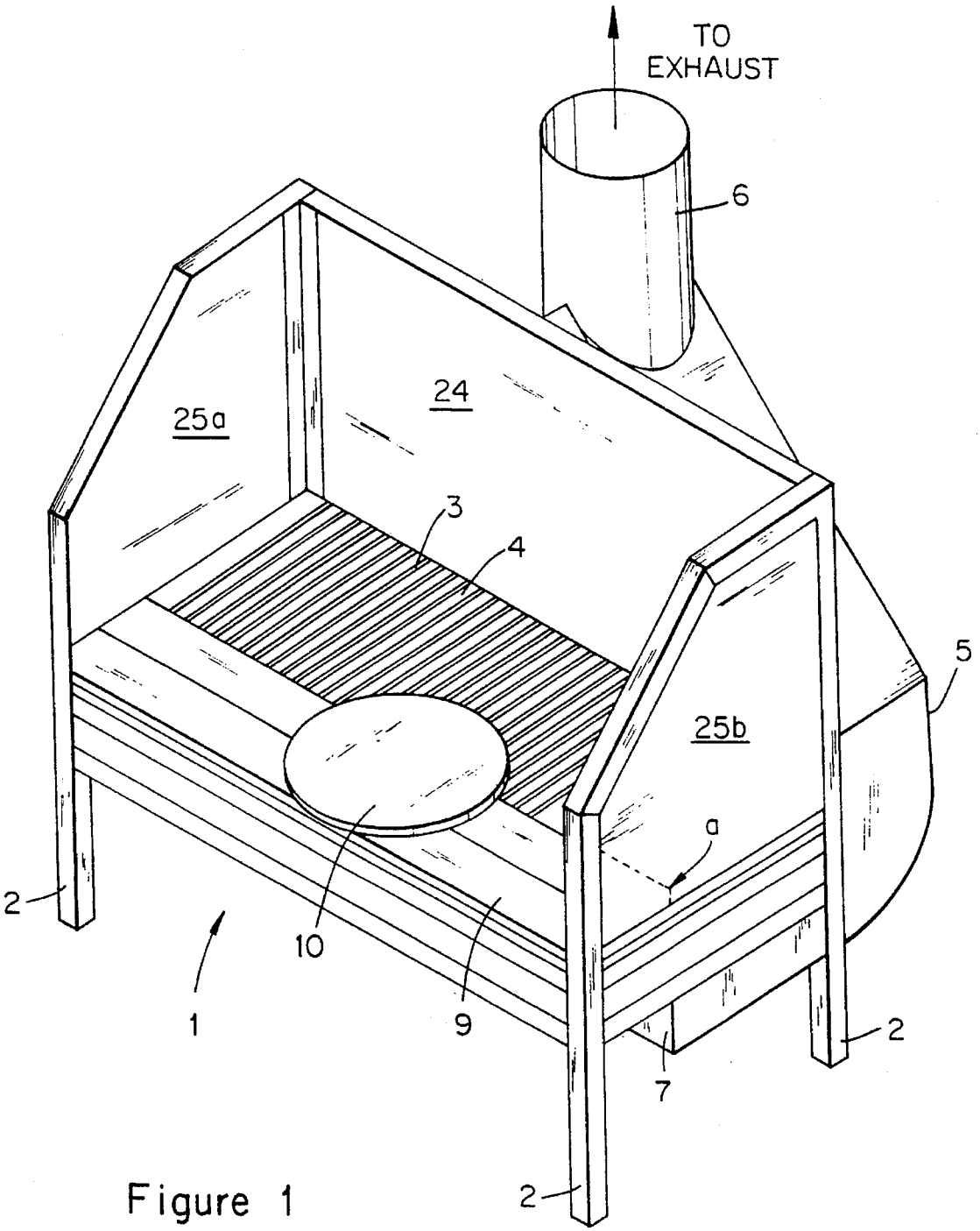
FIG. 1 is a perspective view of a ventilated workstation according to one embodiment of the present invention.
Figure 3:
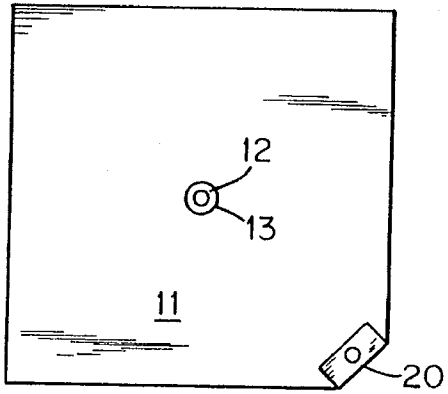
FIG. 3 is a top view of the turntable base which shows the position of an aperture for receiving a locking pin.

FIG. 1 is a perspective view of a ventilated workstation according to one embodiment of the present invention. As shown in FIG. 1, the workstation includes a bench 1 having a plurality of legs 2. The bench 1 includes an upper surface 3 which defines a primary work area of the workstation. The upper surface 3 can be substantially horizontal or tilted at a desired angle to present a workpiece in a convenient position for cleaning or machining.

The upper surface 3 can be constructed of any suitable material selected according to the type of workpiece or the process being performed at the workstation. For example, for metal castings it may be preferred to use wood in order to protect the casting from damage resulting from incidental contact with the upper surface 3. Other suitable materials from which to make the upper surface 3 include plastics, metals, combinations thereof or any material that can be appropriately formed and which has suitable strength, shape, durability, etc.

The upper surface 3 is provided with ventilation openings 4 which are show in FIG. 1 as being formed as spaces between a grating structure. The ventilation openings 4 in the upper surface 3 permit the exhausting of gases and particulate matter away from the primary work area. Thus, during cleaning or machining operations such as grinding or sanding, particulates discharged from a workpiece can be entrained in a vented airstream which is drawn downward though the ventilation openings 4 as discussed below. The ventilation openings 4 can be formed by slots, gratings, various arrays of apertures in the upper surface 3, screens, or the like. In this regard, the upper surface 3 can be constructed of any suitable material selected according to the type of workpiece or the process being performed at the workstation.

The workstation shown in FIG. 1 includes a manifold 5 which is connected to the upper surface 3 beneath the bench 1. The manifold 5 includes an exhaust vent 6, which during operation can be connected to a vacuum source (not shown). In operation, the exhaust vent 6 of the manifold 5 is connected to a suitable vacuum source so that air is drawn downward though the ventilation openings 4 in the upper surface 3 of the bench 1. Ideally, the vented air flow measured at the upper surface 3 should be between about 100 to 250 cfm/ft$^2$.

The connection of the manifold 5 and the upper surface 3 is preferably coextensive. In this regard, the front edge 7 of the manifold 5 shown in FIG. 1 extends at least to the front edge of the upper surface 3 as indicated in the phantom lines at point "a". In other embodiments, the bench 1 can include a chamber beneath the upper surface 3, including clean-out doors or drawers, and the manifold 5 can be connected to the chamber either at a lower portion thereof or at a rear portion thereof in a known manner.

FIG. 1 shows the manifold 5 as including an exhaust vent 6 that is directed upward. It is to be understood that the manifold 5 could alternatively include an exhaust vent that was directed downward or sideways. The direction of the exhaust vent 6 would be determined by the vacuum facilities on site at the foundry or machine shop. It is further possible to include an exhaust fan in the conduit upstream of the exhaust vent 6 to draw the necessary air flow through the bench 1.

In order to control the air flow through the bench 1, a movable damper (not shown) or damper can be included in the manifold 5 to limit or regulate air flow.

As discussed above, the bench 1 can be supported by a plurality of legs 2. Alternative means for supporting the bench 1 include wall mounts that attach the bench 1 to a wall or ceiling mounts that permit the workstation to be suspended from the ceiling. The choices of the mounting options and the particular means to obtain satisfactory support for the bench 1 are within the skill of the designer, based on the intended uses of the workstation.

Figure 2:
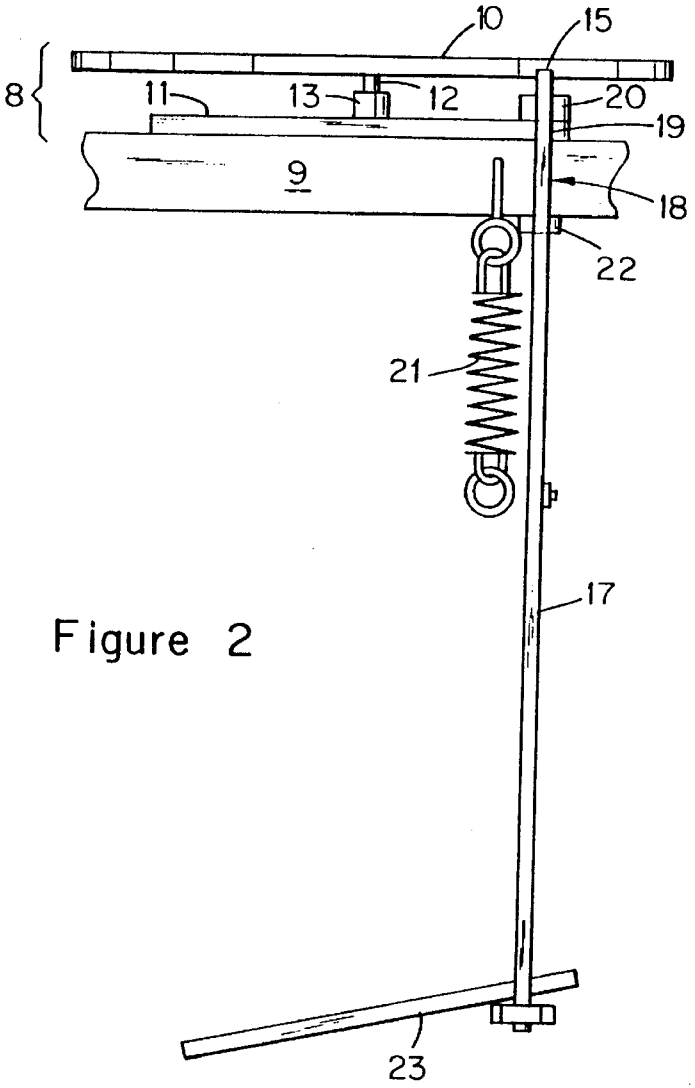
FIG. 2 is a side elevation view showing the mechanism by which the turntable can be locked into a desired position or released for rotation according to one embodiment of the present invention.

The workstation includes means to rotatably support a workpiece on the upper surface thereof so that all surfaces of the workpiece are accessible for cleaning or machining. As shown in FIGS. 1 and 2, the rotatable support means can be a turntable 8 which is attached to a solid table top 9 which is coplanar with the upper surface 3 and extends toward the front of the work station as shown in FIG. 1. In an alternative embodiment, the rotatable support could be positioned over the upper surface 3 so that the separate table top 9 could be eliminated. The table top 9 provides a solid surface upon which tools, tool bits, and the like can be laid.

FIG. 2 is a side elevation view showing the mechanism by which the turntable 8 can be locked into a desired position or released for rotation according to one embodiment of the present invention. As shown in FIG. 2, the turntable includes a turntable top 10 which extends a short distance above the table top 9. The illustrated turntable 8 also includes a turntable base 11 which is attached to the table top 9 by any conventional means, e.g., bolts, screws, or the like. The turntable top 10 is rotatably attached to the turntable base 11 by means of a shaft 12. The turntable top 10 can receive shaft 12 in a central opening 14 and thereby rotate relative to shaft 12. Otherwise, the turntable top 10 and shaft 12 rotate together relative to the turntable base 11, in which case shaft 12 is connected to the turntable base 11 through a collar 13 having bushings or bearings. Although the turntable top 10 is designed to be manually rotated, it is to be noted that the rotation of the turntable top 10 could be effected by use of an electric motor or other powered means in a conventional manner.

Figure 5:
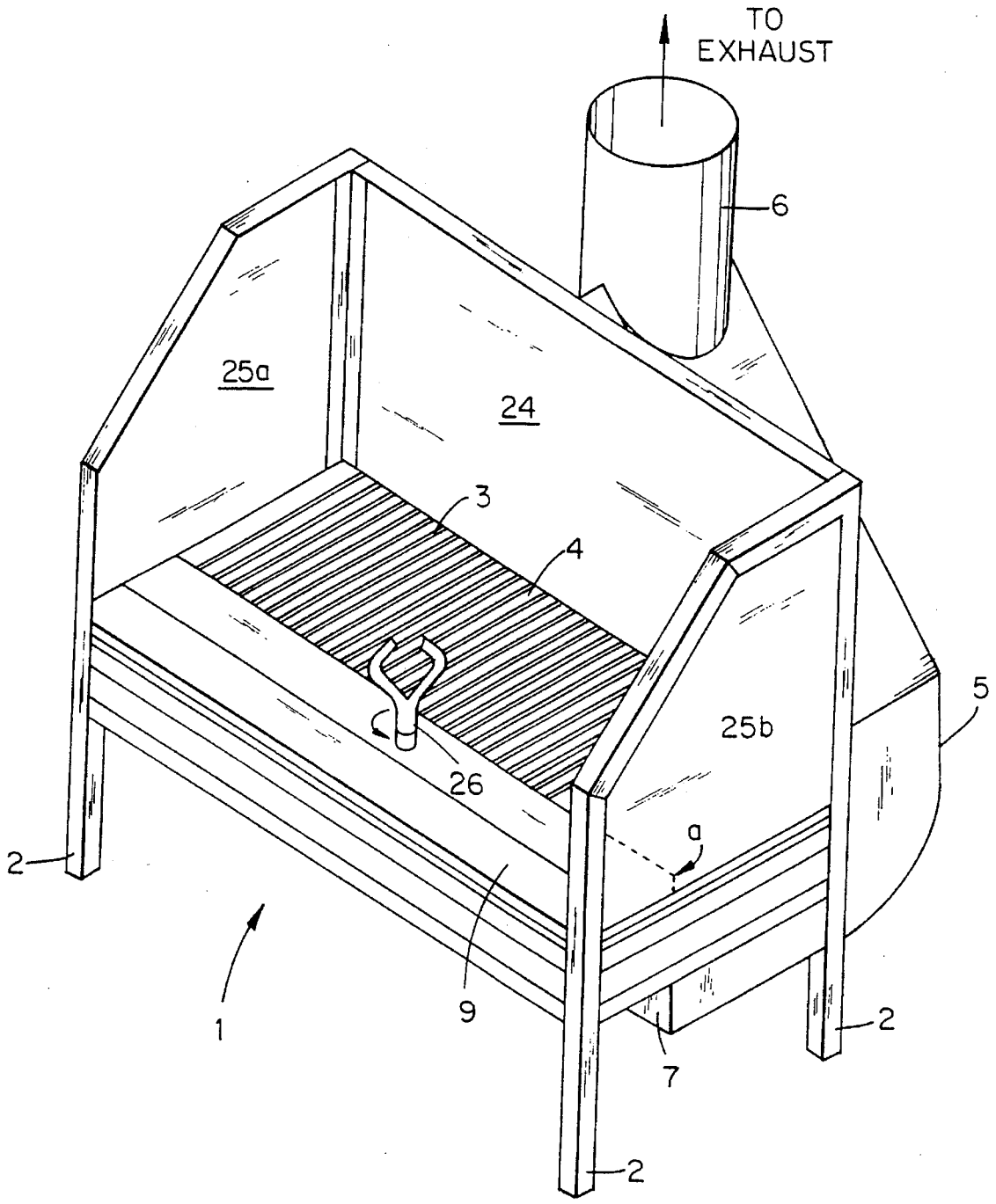
FIG. 5 is a perspective view of a ventilated workstation according to one embodiment of the present invention which includes a mechanical clamp for rotatably supporting a workpiece.

In place of a turntable 8, the rotatable support can include a mechanical clamp 26 of conventional design, as shown in FIG. 5, which is rotatably attached to the table top 9 or upper surface 3. Such a clamp-type rotating support means can be attached on top of the table top 9 as in the case of the turntable or extend outward from the forward edge of the table top 9. Rotation of the clamp-type support means can be effected either manually or by use of an electric motor or other mechanical powered means for rotating the turntable top in a conventional manner.

Figure 4:
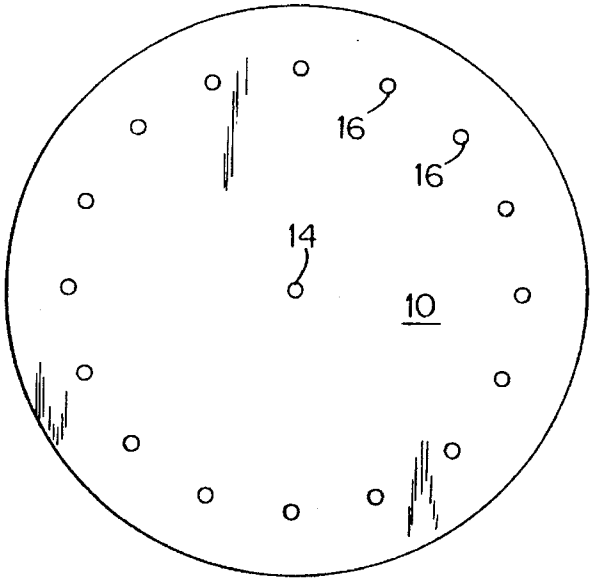
FIG. 4 is a top view of the turntable which shows peripheral apertures that are engageable by the locking pin.

The workstation further includes means for locking the rotational position of the turntable so that a supported workpiece can remain stationary to perform a desired operation on a given portion thereof. The rotational position locking means includes a locking pin 15 which can engage one of a plurality of apertures 16 located about the peripheral edge of the turntable top 10 (FIG. 4). The locking pin 15 extends from locking pin shaft 17 which can move reciprocally through aligned guide apertures 18, 19 formed in the table top and turntable base respectively and through a guide member (not numbered) provided in the turntable base 20.

The locking pin shaft 17 is biased upward by a spring means 21 or other suitable biasing means. The upward movement of the locking pin shaft 17 is limited by a stop means which includes a collar 22 which can be positioned along the locking pin shaft 17 by means of a set screw (not shown).

The reciprocal movement of the locking pin 15 is effected by a foot pedal 23 which is pivotally connected to the lower end of the locking pin shaft 17. When the foot pedal 23 is depressed by the operator, the locking pin shaft 17 is pulled downward and the locking pin 15 is disengaged from turntable top 10. Releasing the foot pedal 23 allows the biasing force of the spring means 21 to pull the locking pin shaft 17 upwards so that the locking pin 15 engages the turntable top 10. It is to be understood that additional guides could be provided to guide the movement of the locking pin shaft 17. It is also noted that while FIG. 4 shows peripheral apertures 16 through the turntable top 10, it is also possible to utilize bores in the bottom of the turntable top 10 which do not pass through the turntable top 10, but which can be engaged by the locking pin 15.

Alternative rotational locking means may include various latches or locking pins which engage the side of the turntable top 10 or a lower rim provided beneath the turntable top 10. In addition, the turntable top 10 could be rotated by a stop motor which is selected or programmed to move in a series of set angular positions.

The bench 1 of the workstation includes a rear wall 24 and a pair of opposed side walls **25*a* and 25*b*** which help contain particulate matter.

In operation, a vacuum source is connected to the exhaust vent 6 of the work station to provide a suitable flow of air downward through the upper surface 3 to entrain and removed particulate materials. A worker then positions a workpiece on the rotatable support and performs a desired cleaning or machining process on the workpiece. When the operator finds it necessary to reposition the workpiece, he/she depresses the foot pedal 23 to unlock the rotatable support and then causes the rotatable support to rotate to a desired new portion in which it is again locked.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

I claim:

1. A ventilated workstation where a user may perform operations that generate undesirable particulates, comprising:

a bench having an upper surface;

a plurality of ventilation openings in said upper surface;

a solid table top coplanar with said upper surface and extending relative to said bench toward a front of the workstation;

a rotatable workpiece support means attached to said table top for supporting a workpiece above said upper surface; and a ventilation manifold in fluid communication with said upper surface, at a lower portion thereof, for drawing an air flow and particulate matter entrained therein downward through said ventilation openings in said upper surface.

2. The ventilated workstation of claim 1, wherein said rotatable workpiece support means comprises a mechanical clamp.

3. The ventilated workstation of claim 1, wherein said rotatable workpiece support means comprises a turntable.

4. The ventilated workstation of claim 3, further comprising means for operatively preventing rotation of said turntable.

5. The ventilated workstation of claim 4, wherein said means for operatively preventing rotation of said turntable comprises a locking pin which can be activated to engage said turntable.

6. The ventilated workstation of claim 5, wherein said locking pin is connected to a foot pedal which effects movement of said locking pin.

7. The ventilated workstation of claim 6, further comprising a spring biasing means for urging said locking pin in a locking position.

8. The ventilated workstation of claim 3, wherein said upper surface comprises a grating and said ventilation openings comprise spaces within said grating.

9. The ventilated workstation of claim 3, wherein the turntable comprises a turntable base attached to said table top and a turntable top rotatably attached to said turntable base.

10. The ventilated workstation of claim 1, wherein a front edge of said ventilation manifold extends beneath said bench at least to a front edge of the upper surface.

11. The ventilated workstation of claim 1, wherein said bench includes a rear wall and a pair of opposed side walls.

12. The ventilated workstation of claim 1, wherein said upper surface is substantially horizontal.

13. The ventilated workstation of claim 1 wherein said upper surface is inclined at an angle selected to present a workpiece mounted to said rotatable workpiece support means at a convenient position for the user to perform said operations.

14. The ventilated workstation of claim 1 wherein said upper surface is made of either wood or plastic.

15. In a ventilated workstation having a ventilated work surface through which ambient air is drawn downward by an applied suction, the improvement comprising:

a rotatable workpiece support means attached to said ventilated workstation for supporting a workpiece in front of and above said ventilated work surface, to enable ambient air and entrained particulates generated by work done on the workpiece to be drawn downward through the ventilated surface away from a worker working on the workpiece.

16. The ventilated workstation of claim 15, wherein said rotatable workpiece support means comprises a mechanical clamp.

17. The ventilated workstation of claim 15, wherein said rotatable workpiece support means comprises a turntable.

18. A process for cleaning foundry castings, comprising the steps of:

positioning a foundry casting on a rotatable support means mounted on a table top extending in front of and above a ventilated surface of a work bench;

applying a vacuum source to said work bench to create a ventilation air flow downward through said ventilated surface; and rotating said foundry casting together with said rotatable support means to expose surfaces of the foundry casting to a cleaning operation, so that any particulates released from the casting during the cleaning operation are entrained in the ventilated airflow.

19. A process for cleaning foundry castings according to claim 18, wherein said cleaning operation comprises a manual casting-cleaning process selected from the group consisting of chipping, grinding, sanding, polishing and combinations thereof.

20. A process for cleaning foundry castings according to claim 19, wherein said rotatable support means is rotated manually.

* * * * *